US007324322B2

(12) United States Patent
Fujita et al.

(10) Patent No.: US 7,324,322 B2
(45) Date of Patent: Jan. 29, 2008

(54) STATIC ELIMINATOR

(75) Inventors: Tsukasa Fujita, Osaka (JP); Tomonori Shimada, Osaka (JP)

(73) Assignee: Keyence Corporation, Osaka-shi (JP)

( * ) Notice: Subject to any disclaimer, the term of this patent is extended or adjusted under 35 U.S.C. 154(b) by 378 days.

(21) Appl. No.: 11/036,026

(22) Filed: Jan. 18, 2005

(65) Prior Publication Data

US 2005/0174718 A1 Aug. 11, 2005

(30) Foreign Application Priority Data

Jan. 19, 2004 (JP) ..... 2004-010129

(51) Int. Cl.
*H05F 3/00* (2006.01)

(52) U.S. Cl. ..... 361/212; 361/213

(58) Field of Classification Search ..... 361/212–225, 361/231

See application file for complete search history.

(56) References Cited

U.S. PATENT DOCUMENTS 4,941,353 A * 7/1990 Fukatsu et al. ..... 73/504.05
6,522,150 B2 * 2/2003 Fujita ..... 324/455
6,781,136 B1 * 8/2004 Kato ..... 250/423 R
2002/0130269 A1 * 9/2002 Fujii ..... 250/423 R

FOREIGN PATENT DOCUMENTS

JP 2001-85488 A 3/2001
JP 2002-233839 A 8/2002
JP 2003-068497 A 3/2003

* cited by examiner

*Primary Examiner*—Michael Sherry
*Assistant Examiner*—Danny Nguyen
(74) *Attorney, Agent, or Firm*—Smith Patent Office

(57) ABSTRACT

A static eliminator generates ions by applying positive and negative high voltages to a discharge electrode of a discharge head. The static eliminator includes a high voltage power supply unit including a high voltage power supply circuit and a high voltage cable for supplying a high voltage generated in the high voltage power supply unit to the discharge head. The discharge head includes a tubular insulator disposed surrounding the discharge electrode, and a tubular ground electrode placed on an outer periphery side of the insulator. Further, the discharge head includes an electrode holding part for supporting the discharge electrode with the discharge electrode piercing in a deep part of the tubular insulator.

13 Claims, 13 Drawing Sheets

STATIC ELIMINATOR

This application claims foreign priority based on Japanese patent application JP 2004-010129, filed on Jan. 19, 2004, the contents of which is incorporated herein by reference in its entirety.

BACKGROUND OF THE INVENTION

1. Field of the Invention

This invention relates to a static eliminator for generating ions by corona discharge and eliminating static electricity of an object.

2. Description of the Related Art

Among various types of static eliminators, a static eliminator of the type for eliminating static electricity of an object as a spot is known. (Refer to JP-A-2001-85188 and JP-A-2002-233839, which are hereinafter referred as patent documents 1 and 2.)

Patent documents 1 and 2 disclose each a static eliminator having a discharge head including a high voltage power supply circuit. The static eliminator supplies air into the discharge head from an air tube attachable to and detachable from the discharge head and allows the air to pass through the surrounding of a discharge electrode, thereby ejecting ionized antistatic air from the discharge head.

In the spot static eliminator in the related art, the discharge head is comparatively large and the demand for miniaturizing the discharge head cannot sufficiently be met; this is a problem.

SUMMARY OF THE INVENTION

It is therefore an object of the invention to provide a static eliminator for making it possible to miniaturize a discharge head.

It is another object of the invention to provide a static eliminator for making it possible to make the diameter of a discharge head comparatively small and improve routing concerning installation.

It is still another object of the invention to provide a static eliminator for making it possible to miniaturize a discharge head of a static eliminator of the type for receiving supply of air and ejecting antistatic air.

To the ends, according to the invention, there is provided A static eliminator comprising:

- a high voltage power supply unit including a high voltage power supply circuit for generating a high voltage;
- a discharge head including a discharge electrode for receiving a supply of the high voltage generated in the high voltage power supply circuit, and performing corona discharge for generating ions: and
- a high-voltage cable for supplying a high-voltage generated in the high voltage power supply unit to the discharge electrode of the discharge head, wherein the discharge head comprises:

- a tubular insulator disposed surrounding the discharge electrode;
- a tubular ground electrode placed on an outer periphery side of the insulator; and
- an electrode holding part formed in a deep part of the tubular insulator, for supporting the discharge electrode with the discharge electrode piercing in the deep part of the tubular insulator.

That is, according to the invention, the high voltage power supply unit including the high-voltage power supply circuit is provided separately and in the discharge head, the discharge electrode is supported in the deep part of the tubular insulator and the tubular ground electrode is placed on the outer periphery side of the insulator. Therefore, the discharge head can be miniaturized and in addition, if the diameter of the discharge head is made small, insulation and creepage distance between the discharge electrode and the ground electrode can be ensured.

In the invention, preferably a controller for controlling the high voltage power supply unit is provided separately, and the controller and the high voltage power supply unit are connected by wiring. Since the wiring may be low voltage wiring, the length is as desired and thus the flexibility of selection of the installation position of the controller can be enhanced.

Memory storing the output voltage, etc., of the high voltage power supply unit is incorporated in the high voltage power supply unit. When the high voltage power supply unit and the controller are connected, the controller reads the data in the memory and can perform optimum control of the high voltage power supply unit, so that the different types of static eliminators can share the single controller.

The invention can be applied to the static eliminator of the type for supplying air to the surrounding of a discharge electrode and can also be applied to an airless static eliminator for ionizing the atmospheric air in the surrounding of a discharge electrode without supplying air to the surrounding of the discharge electrode.

In the static eliminator of the type for supplying air to the surrounding of a discharge electrode, a high voltage cable is made up of a covered high-voltage core wire for supplying a high voltage to the discharge electrode, a ground cable connected to a ground electrode, and a skin tube housing the covered high voltage core wire and the ground cable, and air is supplied to the surrounding of the discharge electrode using a gap in the skin tube.

Not only for the static eliminator adopting the air supply system described above, but also for an airless static eliminator, a conductive net is provided on the outermost layer of the high voltage cable and forms a frame ground conductor and this frame ground conductor is used as control wiring, whereby the ion balance and the discharge strength can be measured.

Particularly, in the static eliminator adopting the air supply system, the conductive net can cause the high voltage cable to function as a pressure hose and can prevent swelling outward in the diametric direction of the high voltage cable caused by supplying compressed air to the surrounding of the discharge electrode through the inside of the high voltage cable.

DETAILED DESCRIPTION OF THE INVENTION

Figure 1:
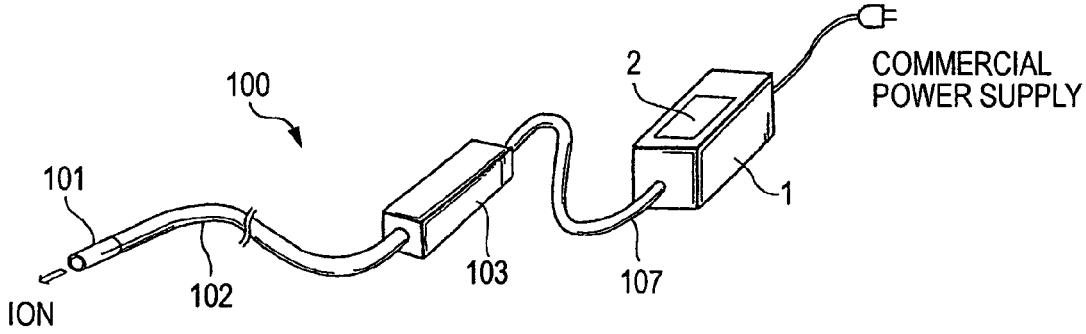
FIG. 1 is a general schematic diagram of an airless spot static eliminator of an embodiment.
Figure 2:
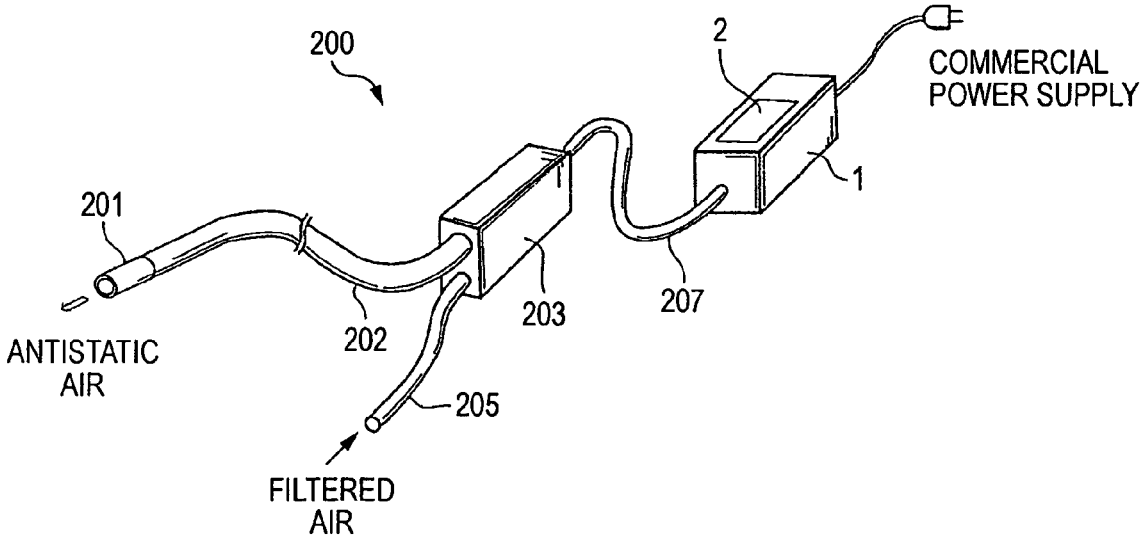
FIG. 2 is a general schematic diagram of an antistatic air ejection spot static eliminator of the embodiment.
Figure 3:
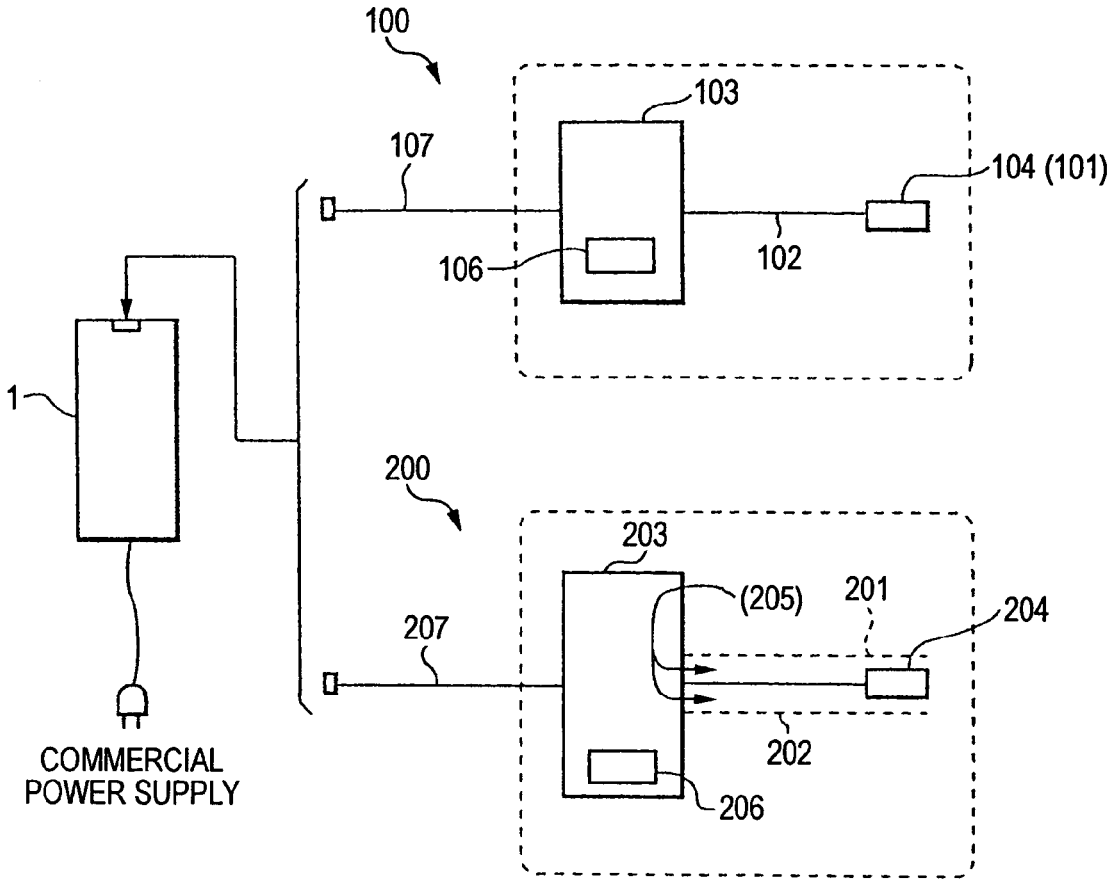
FIG. 3 is a drawing to describe sharing a common controller by the airless spot static eliminator and the antistatic air ejection spot static eliminator.

Referring to FIGS. 1 to 3, static eliminators 100 and 200 of an embodiment are used each in combination with a shared controller 1 and are applied to spot-like static elimination. Preferably, the shared controller 1 includes a monitor 2 and the ion level and the charged state of an object can be displayed on the monitor 2.

The first static eliminator 100 shown in FIG. 1 has a cylindrical discharge head 101 having a diameter of 5 mm to which a high voltage power supply unit 103 is connected via a high voltage cable 102 of a predetermined length having substantially the same diameter as the discharge head 101. The high voltage power supply unit 103 receives supply of DC power, generates AC high voltage, and applies the high voltage through the high voltage cable 102 to an ion generation section 104 (FIG. 3) in the discharge head 101 for ionizing atmospheric air alternately positive and negative.

The second static eliminator 200 shown in FIG. 2 has a cylindrical discharge head 201 having a diameter of 10 mm to which a high voltage power supply unit 203 is connected via a high voltage cable 202 of a predetermined length having substantially the same diameter as the discharge head 201. The high voltage power supply unit 203 receives supply of DC power, generates AC high voltage, and applies the high voltage through the high voltage cable 202 to an ion generation section 204 (FIG. 3) in the discharge head 201 for generating positive and negative ions alternately. An air tube 205 can be attached to and detached from the high voltage power supply unit 203. Compressed air with water content and dust removed through a filter is supplied through the air tube 205 to the high voltage power supply unit 203 and then is supplied through the internal passage of the high voltage power supply unit 203 and the inside of the high voltage cable 202 to the discharge head 201 from which ionized antistatic air is ejected.

The high voltage power supply unit 103 of the first static eliminator 100 and the high voltage power supply unit 203 of the second static eliminator 200 include a memory 106 and a memory 206 respectively for storing the correction values relevant to the mode difference between the ion generation sections 104 and 204 of the first static eliminator 100 and the second static eliminator 200, the types of discharge electrodes, the output voltage difference between the high voltage power supply units 103 and 203, and the like.

A low voltage wiring cable 107 of any desired length extending from the first static eliminator 100 or a low voltage wiring cable 207 of any desired length extending from the second static eliminator 200 is connected to the shared controller 1. Therefore, through the low voltage wiring able 107 or 207, the shared controller 1 reads the correction values from the memory 106 or 206, sets the optimum values appropriate for the first static eliminator 100 or the second static eliminator 200 connected to the shared controller 1, and executes optimum control appropriate for the first static eliminator 100 or the second static eliminator 200 connected to the shared controller 1.

Figure 4:
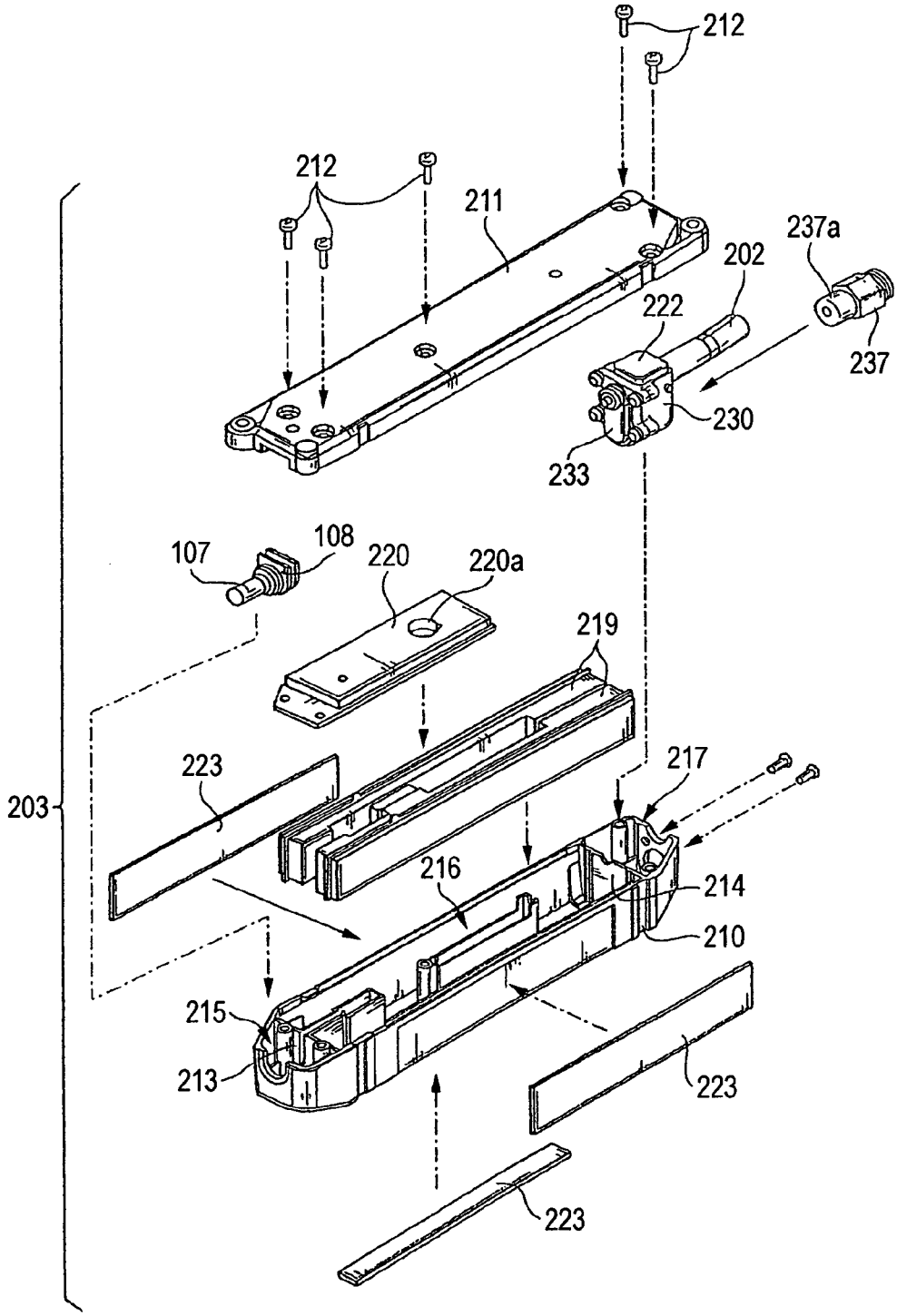
FIG. 4 is an exploded perspective view of a high voltage power supply unit included in the antistatic air ejection spot static eliminator.

FIG. 4 is an exploded perspective view of the high voltage power supply unit 203 of the second static eliminator 200. Referring to FIG. 4, the high voltage power supply unit 203 has a unit case main body 210 shaped roughly like a rectangular parallelepiped with one side opened and a side wall board 211 covering the opening of the unit case main body 210. The side wall board 211 is fixed to the unit case main body 210 with two screws 212 each at each end part and one screw 212 at the center (five in total).

The unit case main body 210 is formed with three rooms 215 to 217 by first and second partition walls 213 and 214 provided in both end portions in the length direction of the unit case main body 210. A catch 108 of the low voltage wiring cable 107 is housed in the first room 215 in one end portion of the unit case main body 210. Two high voltage power supply boards 219 for generating positive and negative high voltages, a high voltage main board 220 for controlling voltage increase operation, and the like are housed in the second room 216 at the center and then a thermally conductive resin is filled thereinto. An air case 222 described later in detail is housed in the third room 217 in an opposite end portion of the unit case main body 210.

Figure 8:
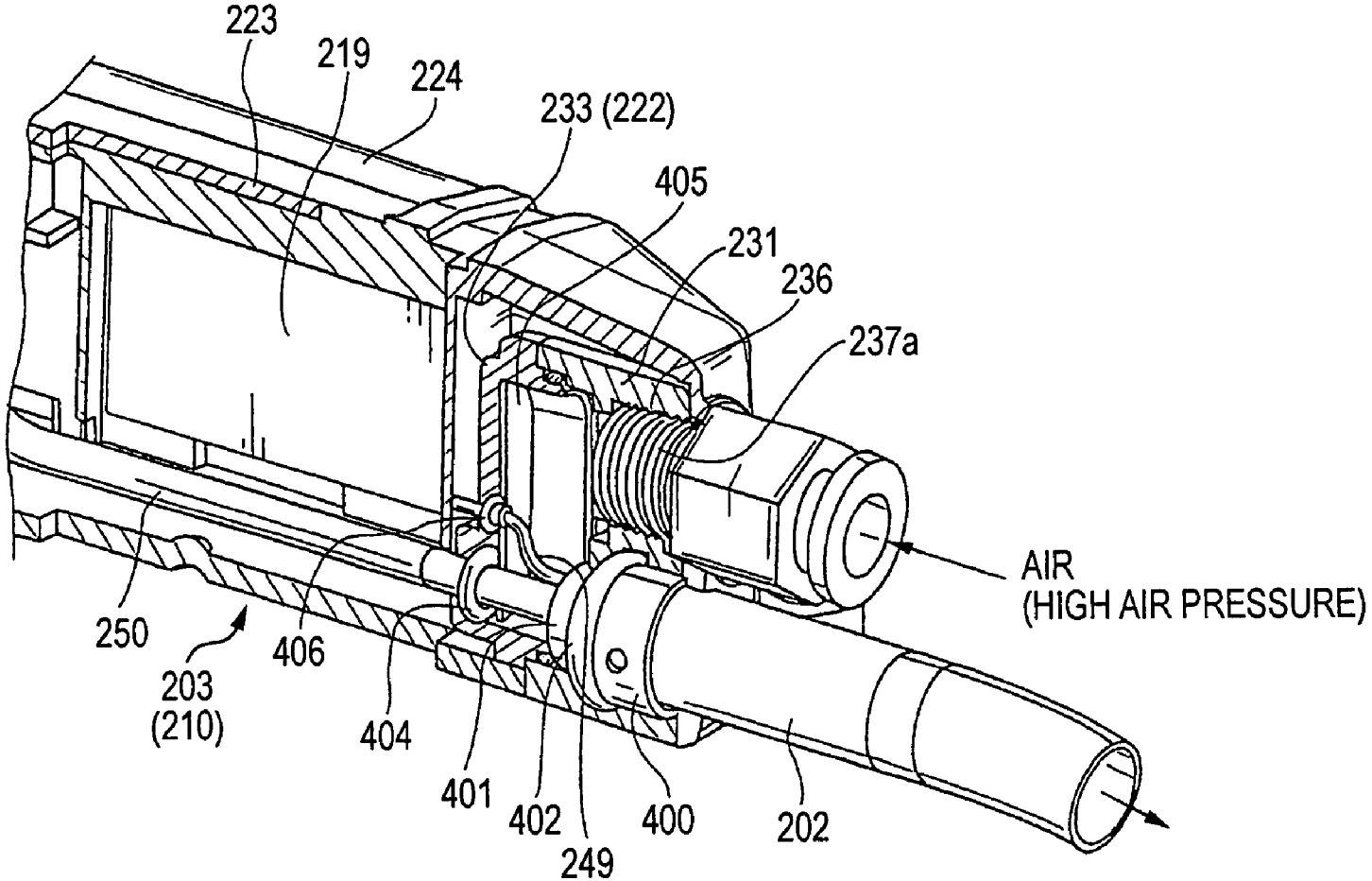
FIG. 8 is an enlarged perspective view of the main part partially broken away when the high voltage power supply unit is viewed in a different direction.

A radiator plate 223 excellent in thermal conductivity, for example, like aluminum is put on each of the three sides of the unit case main body 210, more specifically on each of the sides of the second room 216 at the center for housing the boards 219 and 220. The surrounding of the unit case main body 210 is covered with a shield seal 224 having copper foil laminated on a PET file (FIG. 8) not shown in FIG. 4. The surrounding of the unit case main body 210 is covered with the shield seal 224, thereby making uniform temperatures of the unit case main body 210 and the side wall board 211 and providing the unit case main body 210 and the side wall board 211 with noise resistance and electrostatic shield.

Figure 5:
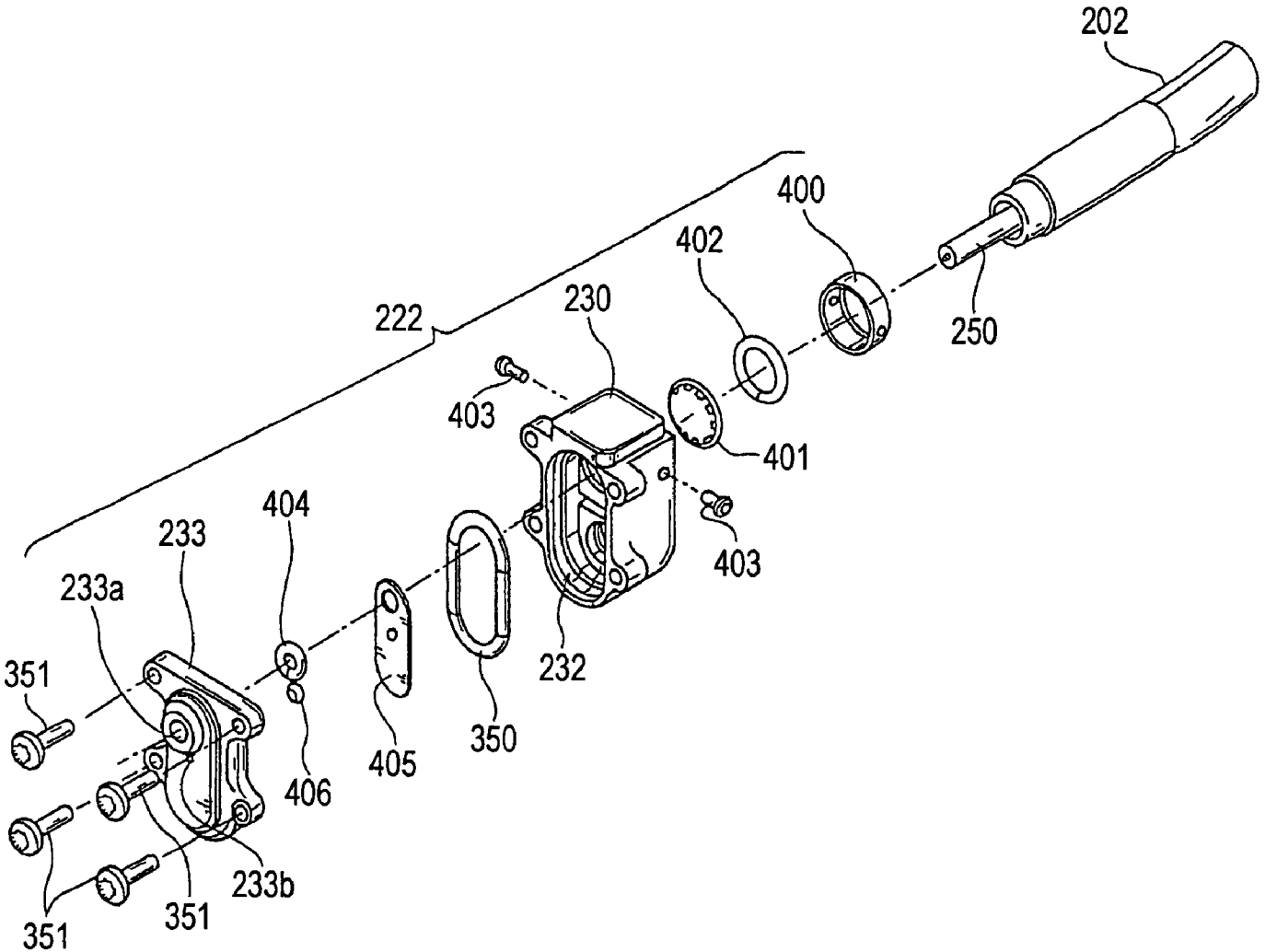
FIG. 5 is an exploded perspective view of an air unit contained in the high voltage power supply unit.
Figure 6:
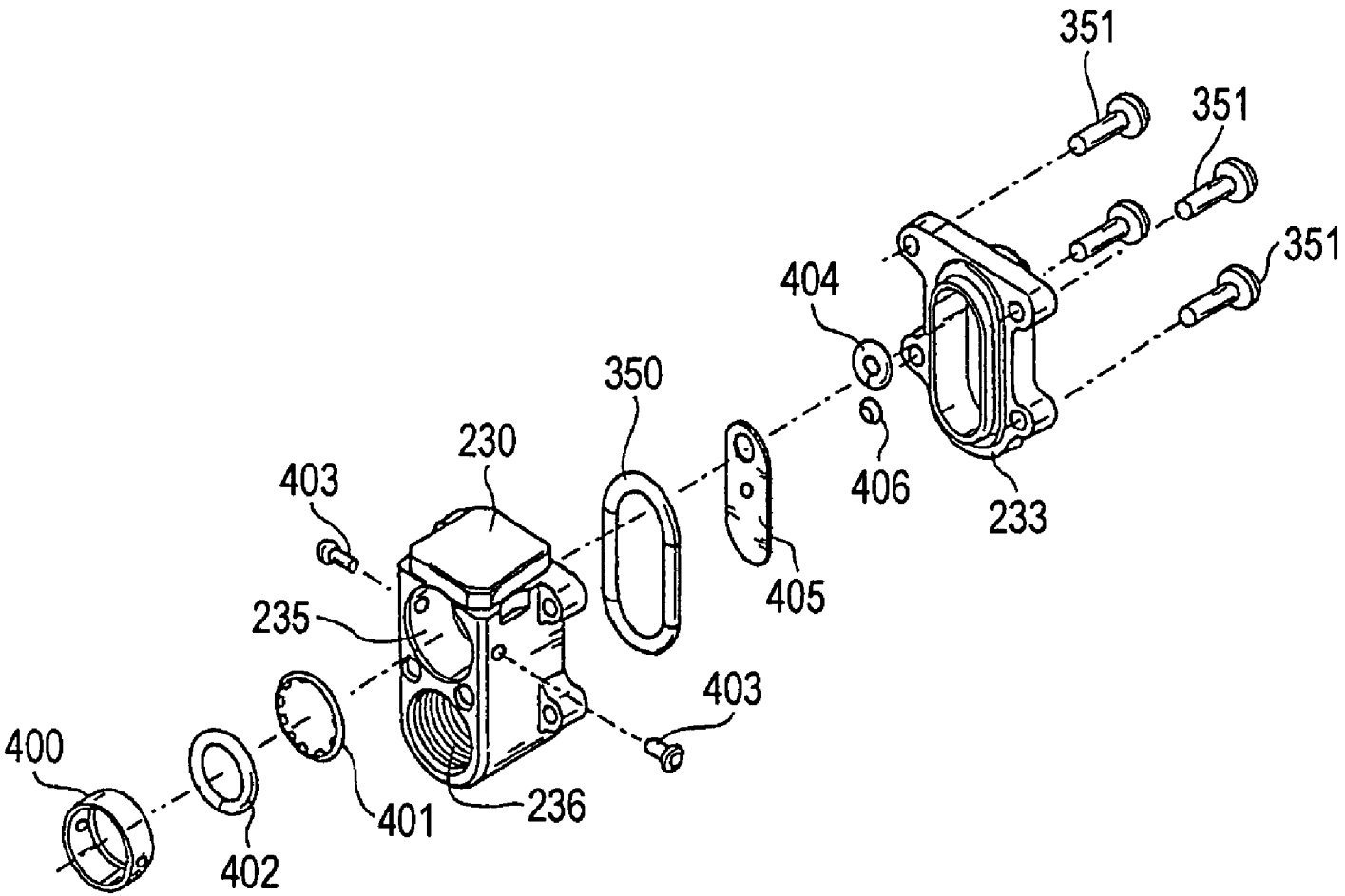
FIG. 6 is an exploded perspective view of the air unit contained in the high voltage power supply unit when the air unit is viewed in a different direction.
Figure 7:
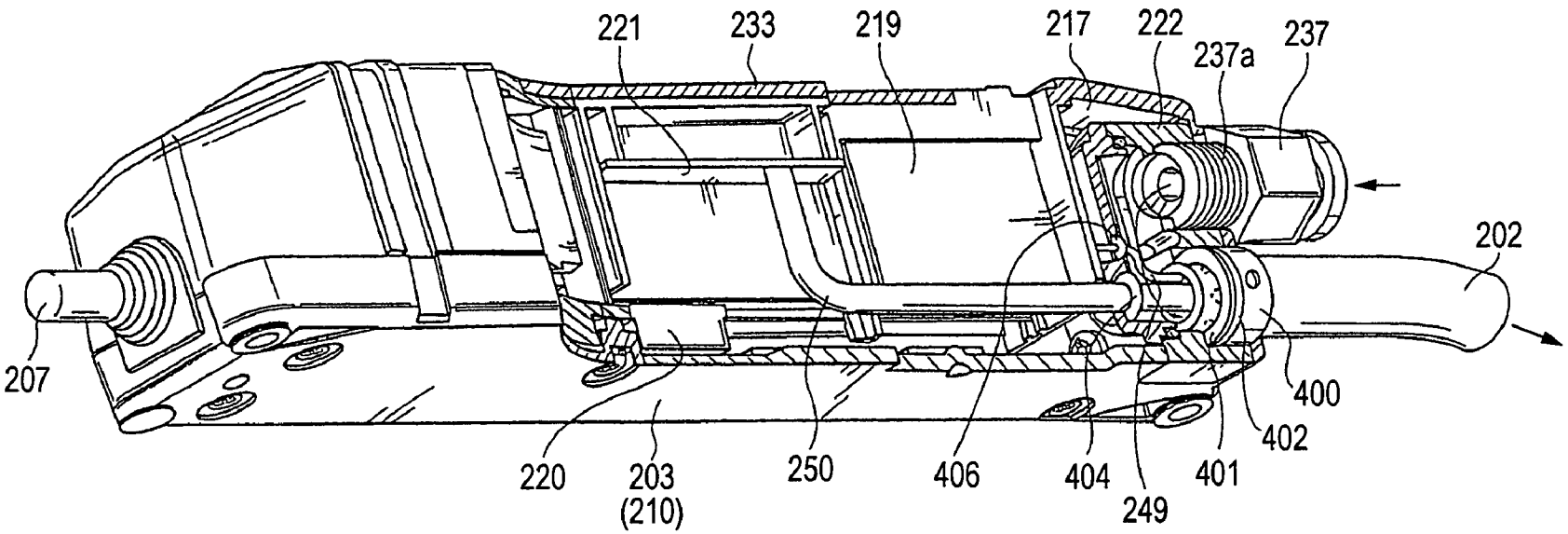
FIG. 7 is a partially cutaway view in perspective of the high voltage power supply unit after the high voltage power supply unit in FIG. 4 is assembled.

FIGS. 5 and 6 are exploded perspective views of the air case 222, and FIG. 7 shows the air case 222 housed in the unit case main body 210. The air case 222 has an air case main body 230 having a side wall 231 (FIG. 8) facing an opposite end wall of the unit case main body 210 and an opening 232 (FIG. 5) opposed to the side wall 231, and the opening 232 of the air case main body 230 is closed by a side wall board 233. The inside of the air case 222 is shaped like an ellipse in a vertical section and an airtight space is formed by a seal material as described later in detail.

The air case main body 230 is formed with two holes 235 and 236 placed away from each other in an up and down direction, namely, longer-axis direction in relation to the internal space shaped like an ellipse in the vertical section. The high-voltage cable 202 is inserted into one hole 235. The other hole 236 is formed as a threaded hole, and a quick coupling unit 237 for accepting detachably one end of the air tube 205 is screwed into the threaded hole 236.

Figure 9:
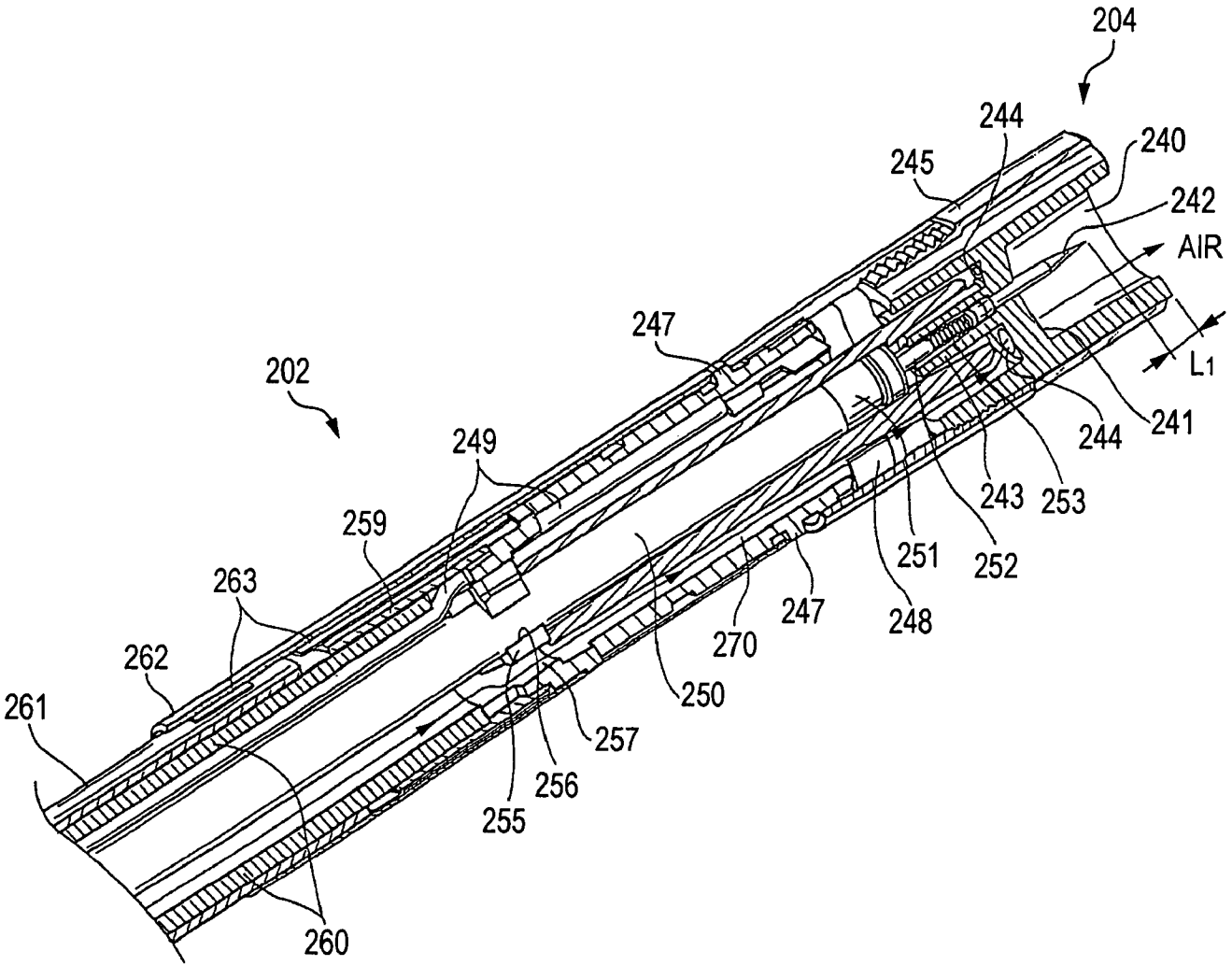
FIG. 9 is a sectional view of a high voltage cable included in the antistatic air ejection spot static eliminator.

FIG. 9 shows the high voltage cable 202 included in the second static eliminator 200. The high voltage cable 202 is provided at the tip integrally with the discharge head 201, namely, the ion generation section 204. The ion generation section 204 includes a cylindrical molded body 240 made of ceramics, namely, having an insulating property, and the cylindrical molded body 240 has a partition wall 241 in an intermediate portion in the length direction. The partition wall 241 is formed with a shaft-like electrode holding part 243 for housing the base end part of a discharge electrode 242 at the center and a plurality of through holes, namely, air passage holes 244 made surrounding the electrode holding part 243.

The outermost peripheral surface of the tip of the high voltage cable 202 is formed by a stainless steel pipe 245, and the stainless steel pipe 245 at the tip is longer than the ceramic molded body 240 and is fitted into the outer periphery of the ceramic molded body 240 to form a ground electrode, namely, a high voltage ground electrode. A more detailed description is given about this point. The base end of the stainless steel pipe 245 at the tip is bonded to a cylindrical fix resin molded body 247 and a belt-like stainless fitment 248 is wound around the tip of the fix resin molded body 247. The stainless fitment 248 has an outer peripheral portion connected to the stainless steel pipe 245 at the tip and an inner peripheral portion connected to a ground cable 249 passing through the inside of the high-voltage cable 202. The ground cable 249 passing through the inside of the high voltage cable 202 has a stainless steel core wire covered with an FEP resin.

On the other hand, in addition to the ground cable 249, a high voltage cable main body 250 is housed in the internal space of the high voltage cable 202. The high voltage cable main body 250 has a high voltage core wire covered with FEP. A contact member 251 is connected to an end of the high voltage cable main body 250 and is connected to the discharge electrode 242 via a contact 252 and a stainless steel spring 253 housed in the electrode holding part 243.

The fix resin molded body 247 is made of a PPS resin and is formed in the base end part with a partition wall 255. The partition wall 255 has a center hole 256 into which the high voltage cable main body 250 is inserted at the center and a plurality of holes 257 made surrounding the center hole 256.

The ground cable 249 is inserted into one of the holes 257 and other holes 257 form a vent hole.

The partition wall 255 at the base end of the fix resin molded body 247 is hermetically joined to a skin tube 260 made of a polyolefin resin by a gasket 259 made of silicone rubber, for example, fitted into the outer peripheral portion of the partition wall 255, and the skin tube 260 extends to the base end of the high voltage cable main body 250.

The surrounding of the skin tube 260 is covered with a stainless steel net 261 and the tip portion of the stainless steel net 261 is covered with a stainless steel pipe 262 extending across the gasket 259 to the proximity of the tip of the fix resin molded body 247. The stainless steel pipe 262 is provided on an inner peripheral surface with a stainless steel supporter 263 for securing a state in which the gasket 259 is in intimate contact with the end parts of the skin tube 260 and the fix resin molded body 247 for preventing air leakage from the gasket 259.

As understood from the description given above, the high voltage cable 202 has the high voltage cable main body 250 for applying a high voltage to the discharge electrode 242 and the ground cable 249 in the skin tube 260, and the internal space of the skin tube 260 is used as an air passage 270 for supplying clean air to the surrounding of the discharge electrode 242.

The high-voltage cable 202 has a net 261 made of a conductive rigid material (stainless steel) provided surrounding the polyolefin tube 260. The conductive net 261 (made of metal such as stainless steel) forms a frame ground and also prevents swelling outward in the diametric direction of the polyolefin tube 260 caused by internal pressure produced as clean air is allowed to pass through the inside of the resin (polyolefin) tube 260. That is, the polyolefin tube 260 made of comparatively flexible resin is surrounded by the stainless steel net 261, thereby functioning as a pressure hose.

As the high voltage cable 202, the tubular ceramic molded body 240 is made to intervene between the discharge electrode 242 made of tungsten, for example, and the stainless steel pipe 245 forming the ground electrode, and the discharge electrode 242 is held in the depth of the tubular ceramic molded body 240, so that insulation and creepage distance between the electrode 242 and the pipe 245 are ensured although the high voltage cable 202 has an extremely small diameter of 10 mm. To ensure the insulation and creepage distance, the more detailed structure of the tip of the high voltage cable 202 for ejecting antistatic air, namely, the ion generation section 204 is as follows: The tip of the discharge electrode 242 is positioned in the deeper part of the ceramic molded body 240 by distance $L_1$ than the tip face of the ceramic molded body 240, and the tip of the stainless steel pipe 245 forming the ground electrode is placed at almost the same position as the tip of the ceramic molded body 240. The tip of the stainless steel pipe 245 may be positioned a little backward from the tip of the ceramic molded body 240 if necessary (the tip of the ceramic molded body 240 may be extended a little forward from the tip of the stainless steel pipe 245).

Figure 10:
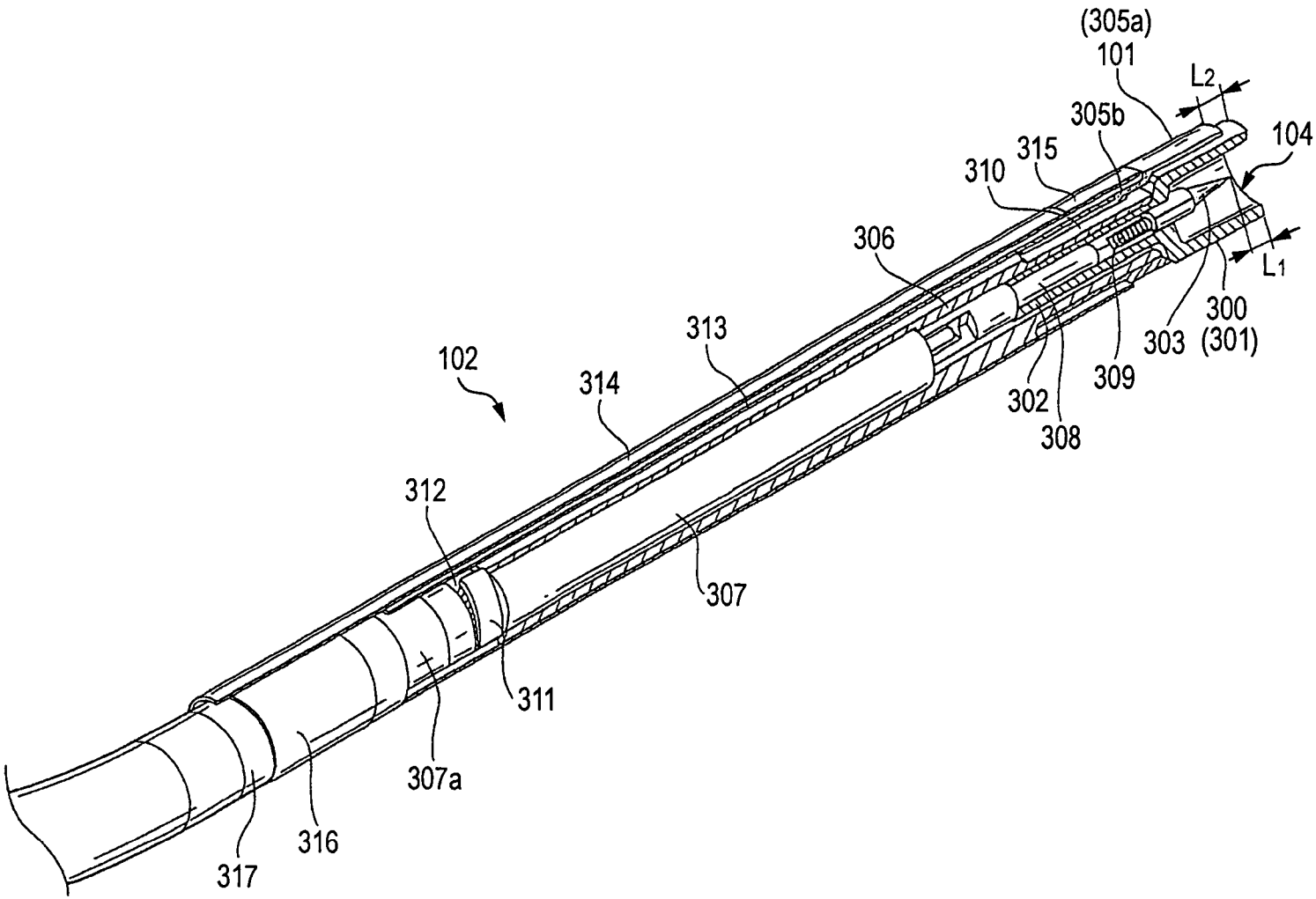
FIG. 10 is a sectional view of a high-voltage cable included in the airless spot static eliminator.
Figure 11:
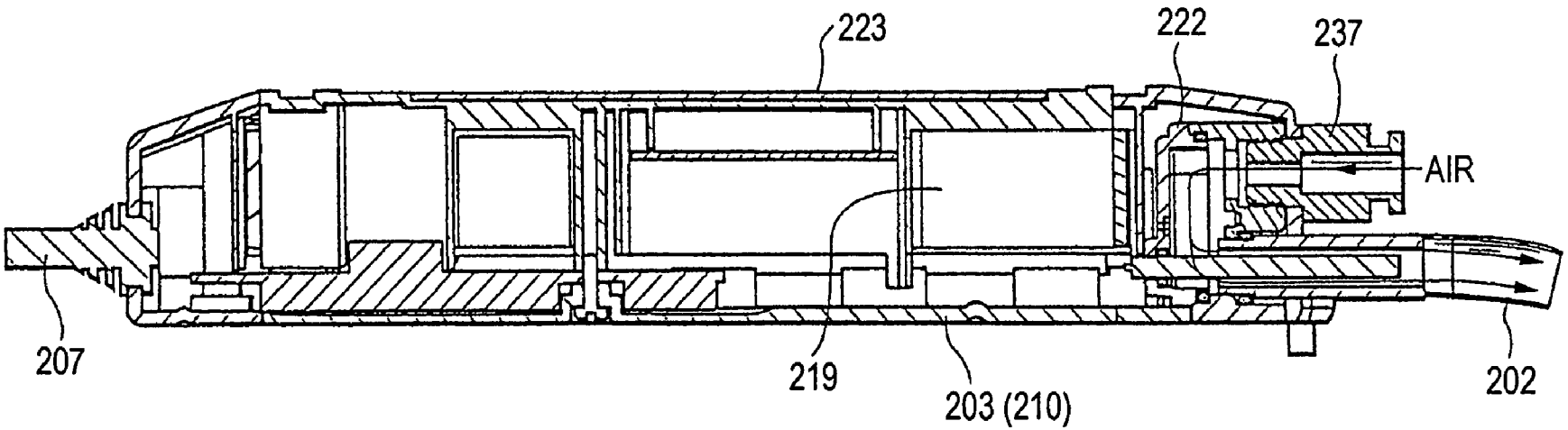
FIG. 11 is a sectional view of the high voltage power supply unit included in the antistatic air ejection spot static eliminator.

FIG. 10 shows the high voltage cable 102 included in the first static eliminator 100. The high voltage cable 102 is airless although the high voltage cable 202 of the second static eliminator 200 forms the air supply passage.

The specific configuration of the high voltage cable 102 will be discussed with reference FIG. 10. The high voltage cable 102 is provided at the tip integrally with the discharge head 101, namely, the ion generation section 104. The ion generation section 104 includes an insulator, specifically a molded body 300 made of ceramics. The insulating molded body 300 has a cylindrical portion 301 in the tip portion and a shaft-like electrode holding part 302 extending backward from the center portion of the base end of the cylindrical portion 301. The base end part of a discharge electrode 303 made of tungsten is housed in the electrode holding part 302.

The outermost peripheral surface of the tip (the discharge head 101) of the high voltage cable 102 is formed by a first pipe 305 made of stainless steel, and the first stainless steel pipe 305 at the tip has almost the same length as the ceramic molded body 300. A cylindrical portion 305*a* of the tip portion of the first stainless steel pipe 305 is fitted into the outer periphery of the cylindrical portion 301 at the tip of the insulating ceramic molded body 300 to form a ground electrode, namely, a high voltage ground electrode.

The tip portion of a conductive pipe 306 made of stainless steel, for example, is fitted into the shaft part 302 of the ceramic molded body 300. A high voltage core wire 307 covered with FEP is housed in the conductive pipe 306 and is connected to the discharge electrode 303 via a contact member 308 and a spring 309.

The first conductive (specifically, stainless steel) pipe 305 forming the high voltage ground electrode has a base end part 305*b* formed in a small diameter, and the small-diameter base end part 305*b* is connected to the conductive pipe 306 via a first conductive material, namely, a belt-like metal piece 310. The base end of the conductive pipe 306 is connected to an aluminum polyester cloth 312 disposed between the high-voltage core wire 307 covered with FEP and an ETFE cover 307*a* via a second conductive material, namely, a belt-like metal piece 311.

The surroundings of the first and second belt-like metal pieces 310 and 311 and the conductive pipe 306 making up the conductor of a high voltage ground are covered with a second stainless steel pipe 314 via an insulating film 313.

The second stainless steel pipe 314 and the first stainless steel pipe 305 are insulated by heat-shrinkable tubing made of a fluorocarbon resin, for example, and the base end part of the second stainless steel pipe 314 is connected to a stainless steel net 317 of the outermost layer via a stainless steel supporter 316, whereby the second stainless steel pipe 314 and the stainless steel net 317 forming the outermost layer of the high voltage cable 102 make up a frame ground conductor.

In short, with the high voltage cable 102 included in the first static eliminator 100, a high voltage is applied to the discharge electrode 303 through the high voltage core wire 307, the contact member 308, and the spring 309, the high-voltage ground conductor is made up of the first stainless steel pipe 305, the first and second belt-like metal pieces 310 and 311, the conductive pipe 306, and the aluminum polyester cloth 312, and the frame ground conductor is made up of the second stainless steel pipe 314, the stainless steel supporter 316, and the stainless steel net 317.

In the high voltage cable 102 included in the first static eliminator 100, the tubular ceramic molded body 300 is also made to intervene between the discharge electrode 303 and the stainless steel pipe 305 forming the ground electrode, so that insulation and creepage distance between the electrode 303 and the pipe 305 are ensured although the high voltage cable 102 has an extremely small diameter of 5 mm.

As understood by making a comparison with the tip portion of the high voltage cable 202 with air disclosed in FIG. 9 about the point, the tip of the ceramic molded body 300 housing the tip of the discharge electrode 303 in the deep part (distance $L_1$) as with the high voltage cable 202 is positioned projecting by distance $L_2$ forward from the tip of the stainless steel pipe 305 (ground electrode) placed on the outer peripheral surface, whereby the creepage distance and the insulation distance between the discharge electrode 303 and the ground electrode 305 are ensured reliably.

That is, in the airless high voltage cable 102, the ion generation section 104 at the tip has the tubular ceramic molded body 300 opened forward, the discharge electrode 303 being placed along the axis of the ceramic molded body 300 and having the tip at a little deep position from the open end of the ceramic molded body 300, and the cylindrical ground electrode 305 disposed along the outer peripheral surface of the ceramic molded body 300, and the tip of the ceramic molded body 300 projects by distance $L_2$ forward from the tip of the ground electrode 305, thereby ensuring the insulation and the creepage distance of the ion generation section 104 in the airless high voltage cable 102 of the comparatively small diameter substantially identical from the base end to the tip (ion generation section 104).

Preferably, the tip of the stainless steel pipe 305 forming the ground electrode and the tip of the discharge electrode 303 are positioned on the roughly common plane crossing the axis (about $L_1=L_2$). The tip of the stainless steel pipe 305 may be positioned a little behind the tip of the discharge electrode 303 or may be positioned a little ahead of the tip of the discharge electrode 303 as required.

The seal material for ensuring the hermeticity of the air case 222 will be discussed with reference to FIGS. 5 to 7. To begin with, an O-ring 350 shaped like an ellipse is interposed between the air case main body 230 and the side wall board 233 and the side wall board 233 is fixed to the air case main body 230 with screws 351, thereby preventing air leakage from the gap between the air case main body 230 and the side wall board 233.

A screw part 237*a* of the quick coupling unit 237 is covered with a somewhat hard elastic member (for example, comparatively hard rubber), whereby the quick coupling unit 237 is tightly screwed into the threaded hole 236 of the air case main body 230 for preventing air leakage from the screw part 237*a* of the quick coupling unit 237.

To seal the high-voltage cable 202, an O-ring 402 sandwiched between a stainless steel ring 400 and a stainless steel stopper 401 attached to the base end of the high-voltage cable 202 prevents air leakage from the insertion hole 235 on the side of the air case main body 230. The conductive (stainless steel) ring 400 attached to the base end of the high voltage cable 202 is fixed with conductive screws 403 and a ground line (not shown) is connected to a terminal (not shown) together fastened by the conductive screws 403.

The high voltage cable main body 250 piercing the inside of the air case 222 passes through a through hole 233*a* of the side wall board 233 is connected to a high voltage relay board 221 through which the high voltage cable main body 250 is connected to the high voltage power supply board 219.

An example of the layout of the boards placed in the high voltage power supply unit 203 will be discussed with reference to FIGS. 4 and 7. Preferably, the two high voltage power supply boards 219 and 219 for generating positive and negative high voltages are made to face each other and are placed along and adjacently to the sidewall of the unit case main body 210 (where the radiator plate 223 is placed), the high voltage main board 220 and the relay board 221 are placed in an intermediate portion in the length direction of the unit case main body 210, the high voltage main board 220 is provided with a through hole 220*a*, and the high-voltage cable main body 250 of the high-voltage cable 202 is connected through the through hole 220*a* (FIG. 4) to the relay board 221 and is connected from the relay board 221 to the high voltage power supply board 219 via a flexible cable (not shown). In doing so, routing of the high voltage cable main body 250 comparatively hard to bend is facilitated, whereby the high voltage power supply unit 203 can be miniaturized.

An O-ring 404 of a first seal member through which the high voltage cable main body 250 is inserted is disposed in the first through hole 233*a* of the sidewall board 233 for sealing the through hole; the first O-ring 404 is pinched by a press plate 405 put on the rear of the side wall board 233 with a double-faced tape between the plate and the side wall board 233.

The ground cable 249 (not shown in FIG. 5) piercing the inside of the air case 222 together with the high voltage cable main body 250 pierces a second through hole 233*b* of a small diameter, of the side wall board 233 and is connected to the high voltage main board 220.

An O-ring 406 of a second seal member is disposed in the second through hole 233*b* of a small diameter for sealing the through hole; the second O-ring 406 is also pinched by the press plate 405 between the plate and the side wall board 233 like the first O-ring 404 described above.

The air case 222 having the described seal structure is housed in the third room 217 positioned in the end part of the unit case main body 210, whereby in the high-voltage power supply unit 203, filtered air is supplied to the air case 222 through the air tube 205 connected to the end face of the high voltage power supply unit 203 and the filtered air entering the air case 222 is inverted in the flow direction in the air case 222 and enters the internal passage of the high voltage cable 202 and is supplied through the high voltage cable 202 to the ion generation section 204.

According to the embodiment, for the different types of static eliminators 100 and 200, the high voltage power supply units 103 and 203 of the static eliminators are provided with the memory 106 and the memory 206 for previously storing the correction value therein, the high voltage power supply unit 103 or 203 of the static eliminator 100 or 200 used in combination with the shared controller 1 is connected to the shared controller 1, and the shared controller 1 reads the correction value from the memory 106 or 206, so that optimum control of the connected static eliminator 100 or 200 can be executed.

As in the high voltage power supply unit 203, the elongated case main body 210 is provided, the high voltage power supply board 219 is divided into two parts, voltage is increased for each board 219 for increasing the voltage at the two stages of the two boards 219, each high voltage power supply board 219 is placed along the side wall of the case main body 210, and the radiator plate 223 is placed on the side wall, whereby heat radiation can be enhanced. Further, the case main body 210 is covered with the shield seal 224 containing copper foil, so that the temperature distribution of the high voltage power supply unit 203 can be made uniform and noise resistance, etc., can be ensured.

From one end face of the high voltage power supply unit 203, a high voltage is taken out using the high voltage cable 202 and air is supplied from the air tube 205 connected to the one end face to one end part of the high voltage power supply unit 203 for generating antistatic air using the internal space of the high voltage cable 202. Thus, the diameter of the discharge head 201 can be made small as compared with joining the air tube to the discharge head as in the related art, so that the diameter of the high voltage cable 202 can be made substantially identical from the base end to the tip, for example.

The conductive net 261 positioned on the outermost layer of the high voltage cable 202 and forming the frame ground can prevent swelling outward in the diametric direction of the high voltage cable 202 caused by supplying air to the ion generation section 204 using the high voltage cable 202.

Since the airtight air case 222 of a separate component is housed in one end part of the high voltage power supply unit 203, the high voltage cable 202 can be set in the case main body 210 with the high voltage cable 202 previously built in the air case 222, so that the assembling property of the high voltage power supply unit 203 can be enhanced. Since the screw part 237*a* of the quick coupling unit 237 is covered with the comparatively hard elastic seal material, sealing property can be ensured simply by screwing the screw part 237*a* into the threaded hole 236 of the air case 222.

As the common advantage to the first and second static eliminators 100 and 200, the high voltage power supply unit 103, 203 and the shared controller 1 are made separate and thus the length of the low voltage wiring cable 107, 207 can be set as desired between the high voltage power supply unit 103, 203 and the shared controller 1, so that the flexibility of selection of the place where the shared controller 1 is disposed can be enhanced and the ease of use can be enhanced.

Figure 12:
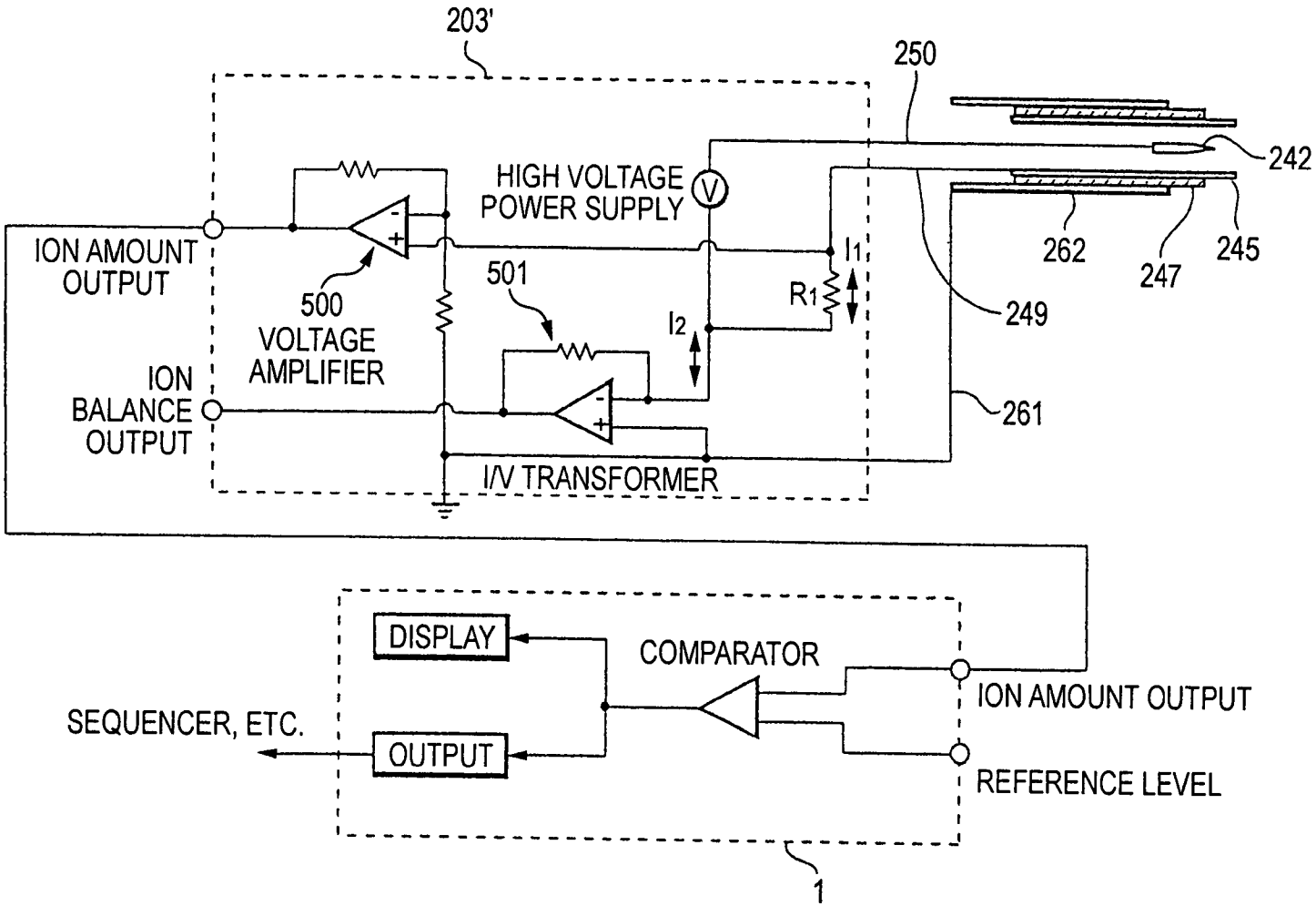
FIG. 12 shows a discharge strength measuring circuit and an ion balance measuring circuit that can be built in the static eliminator of the embodiment.

Although not limited to the first or second static eliminator 100 or 200, when positive and negative ions are generated by corona discharge, electrons exist in the proximity of the discharge electrode and are very light as compared with the ions and thus the electrons move by an electric field between the discharge electrode and the ground electrode and flow into the ground electrode, whereby electric current always flows from the ground into the ground electrode. Therefore, the electric current can be detected for measuring the discharge strength. FIG. 12 shows a circuit for measuring the discharge strength.

Taking the second static eliminator 200 as an example, an ion current detection circuit 203' shown in FIG. 12 is built in the high voltage power supply unit 203 and output of the ion current detection circuit 203' is supplied to the shared controller 1 through the low voltage wiring cable 207.

The ion current detection circuit 203' has a discharge strength measuring circuit 500 including an operational amplifier connected to the ground electrode 245 and amplifies a voltage value associated with the current flowing into the ground electrode 245 corresponding to the discharge strength by the voltage amplifier 500 and supplies the amplification result to the shared controller 1. When the discharge strength becomes smaller than a predetermined value, the current detection circuit 203 displays an alarm on the monitor 2 and outputs to a sequencer (not shown) for performing necessary processing. The user sees the display of the monitor 2 and can replace discharge electrode 242, etc.

The ion current detection circuit 203' has an ion balance measuring circuit 501 including an operational amplifier. Taking the second static eliminator 200 as an example, positive and negative high voltages are applied alternately to the discharge electrode 242 of the second static eliminator 200 for alternately generating positive and negative ions and therefore essentially current $I_2$ becomes zero. The ion balance measuring circuit 501 amplifies the current $I_2$, measures the ion balance, and outputs it to the shared controller 1, which then performs control so that the current $I_2$ becomes zero.

The embodiment of the invention has been described. As for the first and second static eliminators 100 and 200, if the ion balance is not measured, the elements associated with the frame ground conductor forming the control wiring may be omitted from the high voltage cables 102 and 202.

Figure 13:
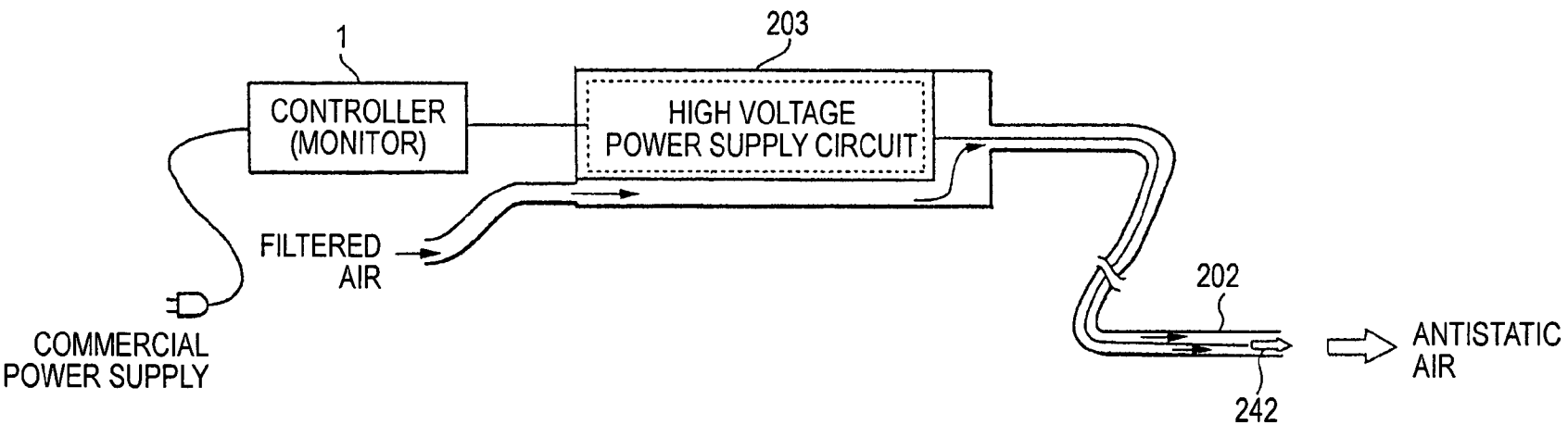
FIG. 13 is a schematic representation of a modification of the antistatic air ejection spot static eliminator.
Figure 14:
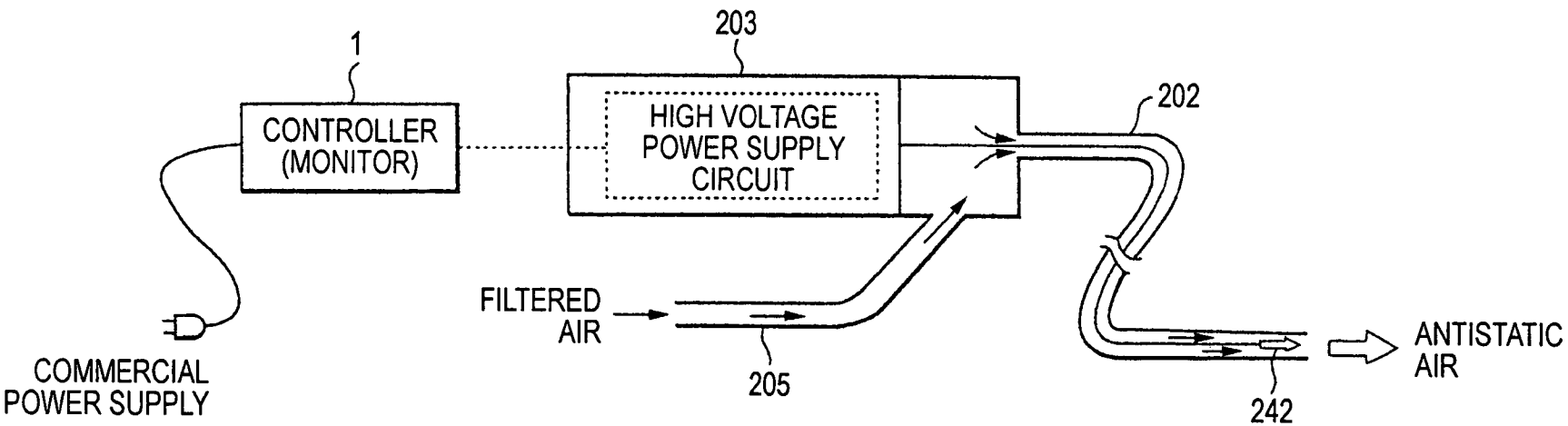
FIG. 14 is a schematic representation of another modification of the antistatic air ejection spot static eliminator.

As for the second static eliminator 200 of the type for ejecting antistatic air, to supply filtered air to the high voltage cable 202, the air tube 205 may be connected to the opposite end face to one end face of the high voltage power supply unit 203 from which the high voltage cable 202 extends, and the high voltage power supply unit 203 may be provided with an internal air passage extending from the opposite end of the high voltage power supply unit 203 to one end, as illustrated in FIG. 13. As another modification, the air tube 205 may be connected to the side of the one end part of the high voltage power supply unit 203 from which the high voltage cable 202 extends, as illustrated in FIG. 14.

What is claimed is:

1. A static eliminator comprising:

a high voltage power supply unit including a high voltage power supply circuit for generating a high voltage;

a discharge head including a discharge electrode for receiving a supply of the high voltage generated in the high voltage power supply circuit, and performing corona discharge for generating ions;

a high voltage cable for supplying a high voltage generated in the high voltage power supply unit to the discharge electrode of the discharge head; and a controller for controlling the high voltage power supply unit, wherein the controller and the high voltage power supply unit are connected by wiring, wherein the discharge head comprises:

a tubular insulator disposed surrounding the discharge electrode;

a tubular ground electrode placed on an outer periphery side of the insulator; and an electrode holding part formed in a deep part of the tubular insulator, for supporting the discharge electrode with the discharge electrode piercing in the deep part of the tubular insulator; and wherein the high voltage power supply unit includes a memory storing the type and output voltage of the discharge electrode associated with the high voltage power supply unit, and wherein when the high voltage power supply unit is connected to the controller, the controller receives the information stored in the memory and performs optimum control of the high voltage power supply unit.

2. The static eliminator as claimed in claim 1 wherein said static eliminator is a static eliminator of the type for eliminating static electricity of an object as a spot.

3. The static eliminator as claimed in claim 1 wherein the insulator is made of ceramics.

4. The static eliminator as claimed in claim 1, wherein the controller has a monitor.

5. The static eliminator as claimed in claim 1 wherein the outermost layer of the high voltage cable comprises:

the tubular ground electrode at the tip of the high voltage cable;

a conductive pipe abutted against an end face of the ground electrode through an insulator; and a conductive net electrically connected to the conductive pipe, wherein the conductive pipe and the conductive net make up a frame ground conductor.

6. A static eliminator comprising:

a high voltage power supply unit including a high voltage power supply circuit for generating a high voltage;

a discharge head including a discharge electrode for receiving a supply of the high voltage generated in the high voltage power supply circuit, and performing corona discharge for generating ions;

a high voltage cable for supplying a high voltage generated in the high voltage power supply unit to the discharge electrode of the discharge head; and an air tube connected to the high voltage power supply unit, wherein the discharge head comprises:

a tubular insulator disposed surrounding the discharge electrode;

a tubular ground electrode placed on an outer periphery side of the insulator; and an electrode holding part formed in a deep part of the tubular insulator, for supporting the discharge electrode with the discharge electrode piercing in the deep part of the tubular insulator;

wherein the high voltage cable comprises a skin tube housing a covered high voltage core wire for supplying a high voltage to the discharge electrode of the discharge head and a ground cable connected to the ground electrode, and wherein compressed air supplied through the air tube to the high voltage power supply unit is supplied to the discharge head through an internal passage of the high voltage power supply unit and a gap of the high voltage cable housing the covered high voltage core wire and the ground cable, and an antistatic air ionized in the discharge head is ejected from the discharge head.

7. The static eliminator as claimed in claim 6 further comprising:

an airtight air case to be incorporated in the high voltage power supply unit, wherein the air tube is connected detachably to the air case.

8. The static eliminator as claimed in claim 7 wherein the air case is housed in one end part of the high voltage power supply unit, the air tube is connected to the air case through one end face of the high voltage power supply unit, and the high voltage cable extends from the one end face of the high voltage power supply unit, and wherein the covered high voltage core wire of the high voltage cable pierces the air case and is connected to the high voltage power supply circuit.

9. The static eliminator as claimed in claim 8 wherein the air case has an airtight internal space shaped like an ellipse in a vertical section formed by an air case main body having a side wall facing an end wall of the high voltage power supply unit and a side wall board for airtightly closing an opening opposed to the side wall, and wherein the air case main body is formed on the side wall with two holes placed away from each other along the major axis in relation to the internal space shaped like an ellipse in the vertical section, the high voltage power supply cable is inserted into one hole through a seal member, and a coupling unit for accepting detachably the air tube is placed airtightly in the other hole.

10. The static eliminator as claimed in claim 6, wherein said static eliminator is a static eliminator of the type for eliminating static electricity of an object as a spot.

11. The static eliminator as claimed in claim 6, wherein the insulator is made of ceramics.

12. The static eliminator as claimed in claim 6, wherein the controller has a monitor.

13. The static eliminator as claimed in claim 6, wherein the outermost layer of the high voltage cable comprises: the tubular ground electrode at the tip of the high voltage cable; a conductive pipe abutted against an end face of the ground electrode through an insulator; and a conductive net electrically connected to the conductive pipe, wherein the conductive pipe and the conductive net make up a frame ground conductor.

* * * * *